United States Patent [19]

Rabus et al.

[11] 4,237,835

[45] Dec. 9, 1980

[54] SPEED-DEPENDENT IGNITION TIMING SYSTEM FOR INTERNAL COMBUSTION ENGINES

[75] Inventors: Friedrich Rabus, Schwieberdingen; Gunter Grather, Pinache; Richard Schleupen, Ingersheim, all of Fed. Rep. of Germany

[73] Assignee: Robert Bosch GmbH, Stuttgart, Fed. Rep. of Germany

[21] Appl. No.: 964,374

[22] Filed: Nov. 28, 1978

[30] Foreign Application Priority Data

Nov. 30, 1977 [DE] Fed. Rep. of Germany ..... 2753255

[51] Int. Cl.[3] ..... F02P 3/04; F02P 5/04

[52] U.S. Cl. ..... 123/418; 123/610

[58] Field of Search ..... 123/148 E, 117 R, 117 D

[56] References Cited

U.S. PATENT DOCUMENTS

| | | | |
|---|---|---|---|
| 3,882,835 | 5/1975 | Randriamanentena | 123/148 E X |
| 3,990,417 | 11/1976 | Tershak | 123/148 E X |
| 4,043,302 | 8/1977 | Sessions | 123/148 E X |
| 4,044,733 | 8/1977 | Suda | 123/148 E X |
| 4,059,083 | 11/1977 | Habert | 123/148 E X |
| 4,167,927 | 9/1979 | Mikami et al. | 123/148 E |
| 4,176,645 | 12/1979 | Jundt et al. | 123/148 E |

FOREIGN PATENT DOCUMENTS 2503899 8/1976 Fed. Rep. of Germany .

*Primary Examiner*—Tony M. Argenbright

*Attorney, Agent, or Firm*—Frishauf, Holtz, Goodman & Woodward

[57] ABSTRACT

A speed discriminator circuit furnishes an upper speed range signal if the engine speed is above a preselected speed. When the engine speed is above the preselected speed, the electronic switch controlling the current flow through the primary winding of the ignition coil is switched to the conductive state at a time when a control signal which varies as a function of actual engine speed becomes less than a speed varying reference signal. The switch is opened, thereby creating the first spark, either when the control signal, which is an AC signal, passes through zero or when the current in the primary winding of the coil has reached a predetermined value indicating that sufficient energy for ignition has been stored in the ignition coil. When the speed is less than the preselected speed the electronic switch is closed when the AC control signal passes through zero and is reopened when the current through the primary winding of the ignition coil is indicative of sufficient stored energy for ignition. A circuit for creating a series of additional sparks following the first spark is also disclosed.

11 Claims, 4 Drawing Figures

SPEED-DEPENDENT IGNITION TIMING SYSTEM FOR INTERNAL COMBUSTION ENGINES

Cross reference to related applications and publications:

U.S. Pat. No. 3,587,551;

DT-OS 2,503,899;

DT-OS 2,549,586; U.S. Pat. No. 176,645, Jundt et al.

DT-OS 2,606,890; U.S. Pat. No. 4,083,347, Gräther and Rabus, both assigned to the assignee of this application.

The present invention relates to ignition systems for internal combustion engines and in particular to the timing systems for such ignition systems. Even more particularly, it relates to ignition timing systems in an internal combustion engine wherein a transducer furnishes an AC control signal indicative of the instantaneous angular position of a shaft relative to a reference position and in which this control signal is utilized to generate the basic timing signal.

BACKGROUND AND PRIOR ART:

An ignition system is described in German Disclosure Document DE-OS 2,503,899 in which a timing signal for determining the ignition time is derived from the passage through zero of the above-mentioned control signal. In the prior art systems, as well as in the present invention, the ignition system comprises a spark plug which is connected in series with the secondary winding of an ignition coil. The primary winding of the ignition coil is connected in series with an ignition switch. During the time the ignition switch is closed, energy builds up in the ignition coil which, when the switch is opened, is transferred to the spark then created in the spark plug. The basic problem for these circuits is to cause the ignition switch to close at a time instant prior to the actual ignition which allows sufficient energy to be stored in the coil to result in an adequate spark. Further, the prior art systems can be divided into two classes namely those in which only one spark is furnished at the desired ignition time and those in which a series of sparks is furnished at this time. For the latter, it is also required that adequate current for the subsequent sparks will flow at the time each subsequent spark is ignited. Systems are known in which a current measuring system is connected to the ignition switch and the current is interrupted by opening of the switch when it is determined that the amplitude of the current is such that sufficient energy is stored in the coil. Such a current measuring system is disclosed in for a single spark system and in U.S. application Ser. No. 734,745, filed Oct. 22, 1976, JUNDT et al, now U.S. Pat. No. 4,176,645, to which German Disclosure Document DE-OS 2,549,586 corresponds U.S. Pat. No. 4,083,347, Gräther and Rabus, to which German Disclosure Document DE-OS 2,606,890 corresponds for a multiple spark system. Basically the problem can be solved in two ways. Either the spark is ignited when the current has the correct value as mentioned above, which can lead to an ignition at other than the actual desired ignition time, or the ignition can take place at the exact ignition time but the current may then not have the desired amplitude. In the known systems, the ignition time is the time at which the above-mentioned control signal passes through zero. If now the ignition switch is closed when the control signal has a predetermined slope or a predetermined amplitude prior to passing through zero, then adequate results can only be obtained at higher speeds since the shape of the curve of the control signal is sufficiently stable and defined only at these higher speeds. At lower speeds, the control signal varies so much that large variations in the closing time of the ignition switch result.

THE INVENTION:

It is an object to furnish an ignition timing system in which proper ignition is obtained even at low speeds and in spite of undesired variations in the amplitude of the control signal.

The present invention comprises limiting speed detector means, namely a comparator, which furnishes an upper speed range signal only when the speed of the shaft as determined from the control signal exceeds a preselected speed. The timing signal furnishing means, for example a known circuit which detects when the AC signal passes through zero, furnishes a timing signal at a predetermined point in each cycle of the control signal. Finally switch control means, namely a plurality of logic circuits, is provided for switching the ignition switch to the conductive state at a time following receipt of the timing signal in the absence of the upper speed range signal, that is when the engine speed is below the preselected speed, and at a time prior to receipt of the timing signal in the presence of the upper speed range signal, namely when the speed of the engine is higher than the preselected speed.

This system takes into consideration that for low engine speeds a variation in the actual ignition time can be tolerated, while at high engine speeds the control signal is sufficiently defined so that it is possible to use a control signal-related criterion for initiating the closing of the switch. The time at which the switch is closed can be varied as a function of speed so that the actual time for which the switch is closed prior to ignition is as constant as possible.

DRAWINGS ILLUSTRATING PREFERRED EMBODIMENT

Figure 1:
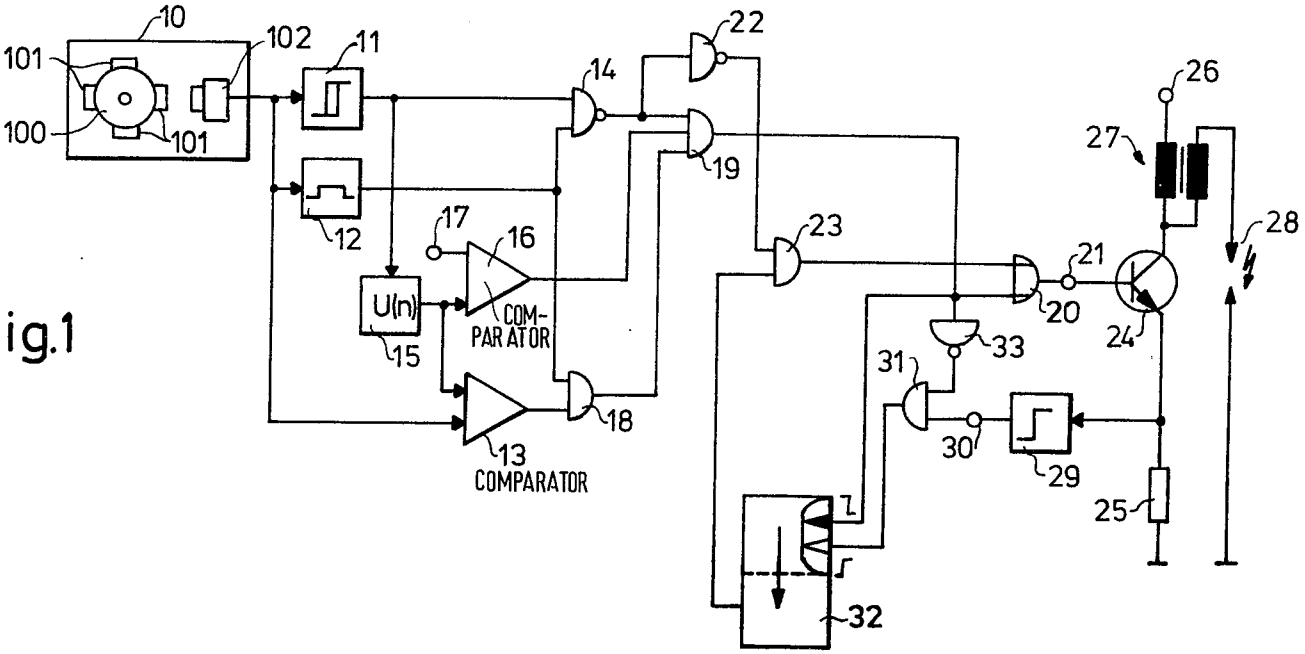
FIG. 1 shows a first preferred embodiment of an ignition timing system according to the present invention.

In FIG. 1 a transducer 10 is connected to the crankshaft of an internal combustion engine. The control signal at the output of sensor 10 is connected to a pulse former stage 11 which may, for example, be a Schmitt trigger circuit. The sensor is indicated as being an inductive sensor but other embodiments which furnish corresponding AC control signals are possible. In FIG. 1, a rotor 100 has four ferromagnetic marks 101 which pass by an inductive sensor 102 and induce AC signals in the sensor. The output of stage 10 is further connected to a stage 12 which furnishes a signal limiting the band of sparks in a system having multiple sparks at each ignition time. Finally, the output of stage 10 is connected to one input of a comparator 13. The output of stage 11 is connected to one input of a NAND gate 14 and one input of a function generator 15. The latter furnishes a speed varying reference signal, that is a signal whose amplitude varies as a function of the engine speed. The output of function generator 15 is connected to one input each of comparator 13 and a second comparator 16. The second input of comparator 16 is connected to a terminal 17 to which a predetermined reference voltage is applied. The output of stage 12 is connected to the second input of NAND gate 14 and to one input of an AND gate 18 whose second input is connected to the output of comparator 13. The outputs of AND gate 18, NAND gate 14 and comparator 16 are connected to respective inputs of an AND gate 19 whose output is connected to a terminal 21 via an OR gate 20. The output of NAND gate 14 is connected through a series circuit including an inverter 22 and an AND gate 23 to the second input of OR gate 20.

Terminal 21 is connected to the base of a power transistor 24. If necessary, a driving stage can be connected between the base of transistor 24 and terminal 21. The emitter of transistor 24 is connected to ground potential through a current measurement resistor 25. The positive terminal of the voltage supply source (not shown) is connected to a terminal 26. The primary winding of an ignition coil 27 is connected between terminal 26 and the collector of transistor 24. The collector of transistor 24 is further connected to ground potential through the secondary winding of ignition coil 27 and through a spark gap 28. In an internal combustion engine the spark gap would be in a spark plug. Although only a single spark gap is shown, a plurality of spark plugs with the required and known high voltage distributor may be provided.

The emitter of transistor 24 is connected to a terminal 30 through a threshold stage 29. Terminal 30 is connected to one input of an AND gate 31. The output of AND gate 31 is connected to a first trigger input of a timing circuit 32. The timing circuit is triggered to an unstable state in response to a positive going edge of a signal applied to this first trigger input. The output of timing circuit 32 is connected to the second input of AND gate 23. The output of AND gate 19 is connected through an inverter 33 to the second input of AND gate 31 and is connected directly to a second trigger input of timing circuit 32. A negative going signal at the second trigger input of timing circuit 32 causes this timing circuit to switch to the unstable state.

Figure 2:
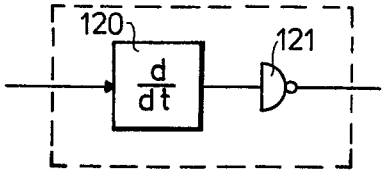
FIG. 2 is a block diagram of a circuit for limiting the time during which multiple sparks are generated at each ignition time.

FIG. 2 shows a preferred embodiment of a circuit for stage 12 of FIG. 1. The input of stage 12 is connected through a differentiating circuit 120 to the input of an inverter 121. The output of inverter 121 constitutes the output of stage 12.

Figure 3:
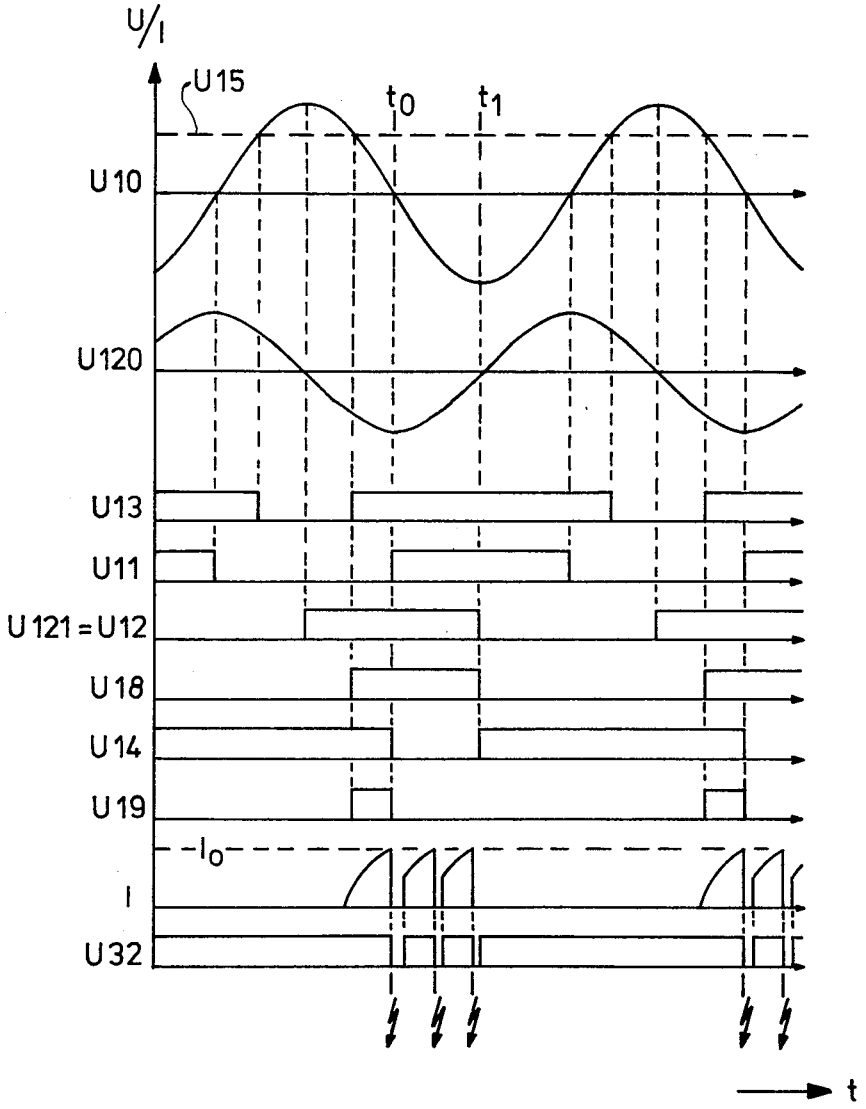
FIG. 3 is a diagram showing the variation of signals with respect to time at various points in the circuit of FIG. 1.

OPERATION:

The operation of the circuits shown in FIGS. 1 and 2 will now be explained with reference to the voltage vs. time diagrams of FIG. 3. The output of transducer 10 is shown as an AC voltage $U_{10}$. This AC voltage $U_{10}$ is differentiated in differentiating circuit 120. The output of differentiating circuit 120 is shown as $U_{120}$. The voltage $U_{121}$ appears at the output of inverter 121 during the negative half wave of signal $U_{120}$. The control signal $U_{10}$ is inverted in pulse former stage 11 and formed into a pulse sequence $U_{11}$. Pulse sequence $U_{11}$ is changed into a voltage $U_{15}$ which varies as a function of engine speed in function generator 15. This type of circuit is known and, in a simple form, may comprise a capacitor which is continuously connected to a discharge circuit and which is controlled, for example, by the trailing edges of the pulses in pulse sequence $U_{11}$. Since these edges occur more frequently per unit time at higher engine speeds, the charge on the capacitor will increase with increasing speed. Function generator 15 can also be embodied in other types of circuits such as are used, for example, in engine speed measuring devices. The output of the function generator, $U_{15}$, is here pictured as a straight line. Of course depending upon the type of speed measuring circuit used, other types of curves may result. The AC voltage $U_{10}$ can also have shapes different from the sine wave shape shown in FIG. 3. The voltages $U_{10}$ and $U_{15}$ are compared to each other in comparator 13 and a signal $U_{13}$ appears at the comparator output when the voltage $U_{15}$ exceeds the voltage $U_{10}$.

The pulse sequence $U_{12}$ and the pulse sequence $U_{13}$ are both applied to AND gate 18. The output of AND gate 18, namely the pulse sequence $U_{18}$, thus contains pulses furnished only in the joint presence of signals in pulse sequences $U_{12}$ and $U_{13}$. Further, the pulse sequence $U_{12}$ is combined with the pulse sequence $U_{11}$ in NAND gate 14. NAND gate 14 thus furnishes a pulse sequence which has pulses which are present except when $U_{12}$ and $U_{11}$ are both present. The absence of pulse $U_{14}$ thus signifies the interval between $t_0$ and $t_1$ in FIG. 3.

Comparator 16 compares the speed-dependent output of function generator 15 to a reference voltage which is applied at terminal 17. If the reference voltage exceeds $U_{15}$, the output of comparator 16 is a "0" signal which causes AND gate 19 to be blocked. This occurs when the engine speed is less than a selected speed, the selected speed being set by setting of reference voltage 17. For engine speeds above the selected speed the output of comparator 16 is a "1" signal and AND gate 19 is conductive.

The operation of the circuit will first be discussed for the condition where the engine speed exceeds the reference speed, that is when the output of comparator 16 is a "1" output. When the output of comparator 16 is a "1" output, the output of AND gate 19 will be a pulse sequence $U_{19}$. In pulse sequence $U_{19}$, each pulse starts when signal $U_{10}$ drops below the speed-dependent reference signal $U_{15}$ in the negative-going half-wave of control signal $U_{10}$ and ends at $t_O$, that is at the ignition time. Since the pulses $U_{19}$ are applied through OR gate 20 directly to transistor 24, the latter is switched to the conductive state at the start of each pulse $U_{19}$ and is switched to the blocked state, thereby creating a spark, at the end of each pulse $U_{19}$. Thus the first spark is generated at the end of each signal $U_{19}$.

The trailing edge of signal $U_{19}$ triggers timing circuit 32 which may, for example, be a monostable multivibrator. The output of timing circuit 32 switches from a "0" signal to a "1" signal for a time determined by its internal time constant in response to the trailing edge of signal $U_{19}$. At the end of the time constant of timing circuit 32, the output of this circuit again changes to a "0" signal. Since the signal at the output of inverter 22 is also a "1" signal, transistor 24 is again switched to the conductive stage. The current I through transistor 24 and the primary winding of coil 27 again increases until the voltage drop across resistor 25 is sufficient to cause threshold stage 29 to furnish a threshold output signal, namely a "1" signal at terminal 30. A "1" signal therefore appears at the output of AND gate 31. The leading edge of this signal triggers the additional spark timing circuit 32 for the second time. This process repeats until the signal at the output of inverter 22 is no longer a "1" signal, that is at time $t_1$. The time $t_1$ is determined by the end of signal $U_{12}$ and is thus the time at which the differentiated signal $U_{120}$ passes through zero, or the signal $U_{10}$ is at its negative peak. The signal $U_{12}$ thus is a signal which limits the band of sparks following the original spark.

If the engine speed is less than the speed selected by the voltage at terminal 17, AND gate 19 is constantly blocked. These conditions are not shown in the diagrams of FIG. 3. Under these conditions transistor 24 switches to the conductive state when the output of AND gate 23 is a "1" signal, that is starting at the trailing edge of signal $U_{14}$ or the leading edge of signal $U_{22}$. Since a "0" signal appears at all times at the output of AND gate 19, a "1" signal appears at all times at the output of inverter 33. If the current in the primary circuit of ignition coil 27 reaches its desired value $I_0$, then, as described above, threshold circuit 29 responds and the timing circuit 32 is triggered via AND gate 31. AND gate 23 is blocked while timing circuit 32 is in the unstable state. The switching from the stable to the unstable state of timing circuit 32 thus triggers the blocking of transistor 24 and therefore the spark. When timing circuit 32 returns to a stable state, the transistor 24 again becomes conductive and the whole process repeats until the end of signal $U_{22}$ is reached. This is the same both at high and at low engine speeds.

For engine speeds below the selected speed, that is under conditions during which control signal $U_{10}$ may have greatly varying characteristics, the above-described apparatus causes transistor 24 to be switched to the conductive state when voltage $U_{10}$ passes through zero and to be switched the blocked state thereby creating the spark when the current through the primary winding reaches its required value or at the end of a timed interval furnished by a timing circuit which was, for example, triggered by the passage through zero of control signal $U_{10}$. The leading edge of signal $U_{11}$ is herein referred to as the timing signal. At low speeds therefore the energy at ignition time is the required ignition energy but the actual ignition time has been delayed by the amount of time required for switch 24 to be closed. This delay in the ignition time can be tolerated at low engine speeds since the delay is only a small percentage of the whole cycle time. For higher speeds, that is for speeds above the selected speed, the time at which switch 24 closes is determined by the speed-dependent voltage $U_{15}$. Transistor 24 switches to the conductive state at that instant in time at which control signal $U_{10}$ decreases to less than the speed-dependent signal $U_{15}$. The actual ignition time, that is the time at which transistor 24 switches back to the blocked state can coincide exactly with the passage through zero of control signal $U_{10}$. In order that the energy at the ignition time may be as close as possible to the theoretically desired ignition energy, the relative values of control signal $U_{10}$ and speed-dependent voltage $U_{15}$ must be so selected that the actual time at which switch 24 switches to the conductive state coincides with the theoretically determined start of conduction.

The time during which additional sparks may be generated is fixed by signal $U_{12}$ to extend over a constant angular region. This results in a particularly good combustion of the mixture. Instead of using the zero slope criterion of control signal $U_{10}$ to limit the band of sparks, other slopes or other criteria may be selected.

At engine speeds higher than the selected speed the current during the first spark may rise to an excessive value. To prevent this, a known current limiter may be introduced into the circuit to limit the primary current to its desired value $I_0$. Such circuits are known and can be found, for example, in U.S. Pat. No. 3,587,551.

Figure 4:
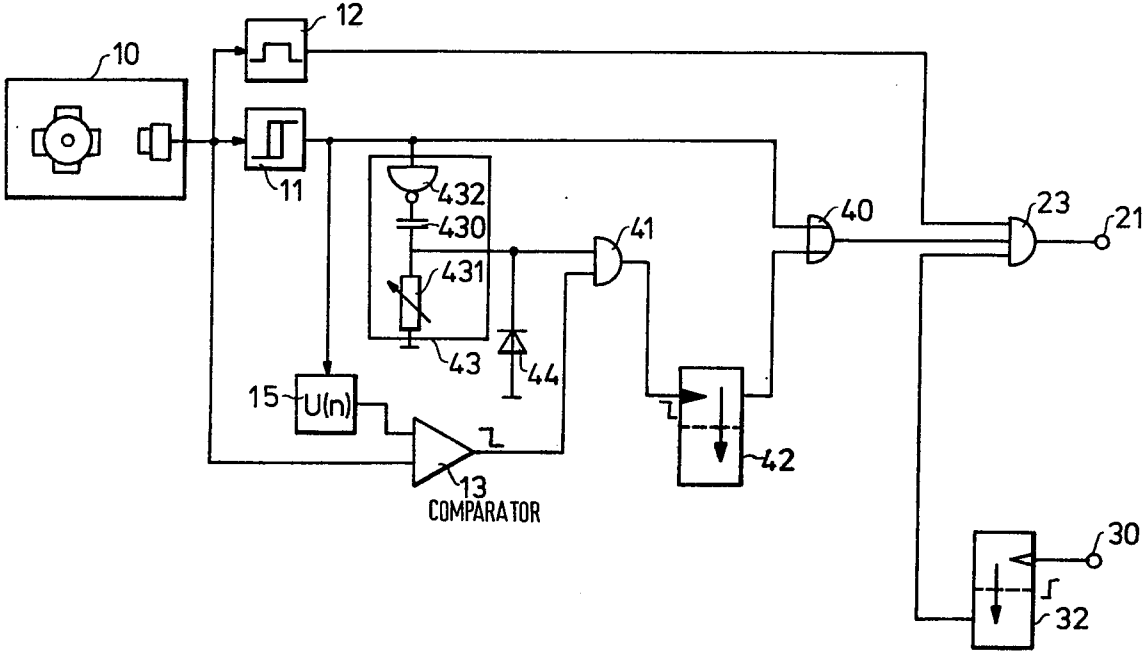
FIG. 4 is a circuit diagram (partially in block diagram form) of a second embodiment of the present invention.

A second preferred embodiment of the present invention which is simpler than that shown in FIG. 1 is shown in FIG. 4. Elements 10–13 and 15 correspond to the elements in FIG. 1 having the same reference numeral. The output of stage 12 is directly connected to one input of AND gate 23 whose output is directly connected to terminal 21. The output of pulse former stage 11 is connected through an OR gate 40 to a further input of AND gate 23. The output of comparator 13 is connected through an AND gate 41 to the input of a timing circuit 42 whose output is connected to a further input of OR gate 40. The output of pulse former stage 14 is also connected through a speed discriminator stage 43 to a further input of AND gate 41. Specifically, the output of pulse former stage 11 is connected to the input of an inverter 432 whose output is connected to a capacitor 430. The other side of capacitor 430 is connected to one side of a variable resistor 431 whose other side is connected to a reference potential such as chassis or ground potential. A diode 44 is connected in parallel with resistor 431. The common point of capacitor 430 and resistor 431 is connected to the one input of AND gate 41 as is the cathode of diode 44. Terminal 30 is directly connected to a trigger input of timing circuit 32. The output of timing circuit 32 is connected to the third input of AND gate 23. Components 24–29 which are not shown in FIG. 4 are identical to those of FIG. 1 and are connected to terminals 21 and 30 as shown in FIG. 1.

The apparatus shown in FIG. 4 operates in much the same way as that of FIG. 1 except that the spark is generated when the current in the primary circuit of the ignition coil 27 has reached the desired value independent of whether the time at which transistor 24 closes is before or after the control signal $U_{10}$ passes through zero. The output of stage 12 directly controls AND gate 23 so that transistor 24 is always blocked after the signal $U_{12}$ ends. Comparator 16 is replaced by the simple speed discriminator stage 43 which furnishes the upper speed range signal, namely a "1" signal, when the speed of the engine exceeds the selected speed. Specifically, capacitor 430 is charged through inverter 432 and resistor 431 after the trailing edge of signal $U_{11}$. For each leading edge of signal $U_{11}$ capacitor 430 is discharged through diode 44, that is with a very short time constant. The voltage developed across resistor 431 by the charging current controls AND gate 41. At higher speeds the period of signal $U_{11}$ is shorter, so that the charging current at the time of the ignition signal is higher than it is at low engine speeds. Below a predetermined limiting value of this charging current, and therefore below the preselected speed, the voltage across 431 constitutes a "0" signal for AND gate 41. Above the preselected speed, as is determined by the adjustment of resistor 431, a "1" signal is applied to AND gate 41 and causes AND gate 41 to be conductive for signals $U_{13}$. The negative going edges of signal $U_{41}$ trigger the timing circuit 42 which may also be a monostable multivibrator. A "1" signal then appears at the output of timing circuit 42 so that a signal at the output of AND gate 23 causes transistor 24 to become conductive. When the primary current in the primary winding of ignition coil 27 reaches its desired value $I_0$, timing circuit 42 causes the generation of a series or band of sparks as in the circuits of FIG. 1. The generation of the spark band is made possible by the fact that a "1" signal at the output of OR gate 40 is maintained by signal $U_{11}$ starting at time $t_0$.

Below the selected speed AND gate 41 is blocked and ignition takes place as in the first embodiment under control of signal $U_{11}$, the first switching to the conductive state of transistor 24 taking place at time $t_0$.

Various changes and modifications may be made within the scope of the inventive concepts.

The following data applies to a preferred embodiment:

| | |
|---|---|
| Preselected engine speed: | 2000 rpm |
| Duration of spark band: | 4 ms |
| Shape of voltage $U_{15}$ with respect to time | |
| a) at constant engine speed: | dc = fln |
| b) at increasing engine speed: | |
| c) at decreasing engine speed: | |
| Shape of voltage $U_{10}$: | Sinusoidal |
| Amplitude of voltage $U_{10}$: | 20 v |
| Desired value of primary current at ignition time: | 50A |
| Time constant of monostable multivibrator 32: | 100 ms |
| Time constant of monostable multivibrator 42: | 300 ms |

We claim:

1. In an internal combustion engine having a shaft, control signal furnishing means (10) coupled to said shaft for furnishing a speed varying cyclical control signal, and an ignition system, said ignition system having spark creating means (27, 28) and ignition switch means (24) having a first and second stable state connected to said spark creating means for furnishing energy to said spark creating means when in said first stable state and for triggering said spark creating means to create said spark when switching from said first to said second stable state, an ignition timing system comprising limiting speed detector means (16, 23) connected to said control signal furnishing means for furnishing an upper speed range signal only when the speed of said shaft exceeds a preselected speed; timing signal furnishing means (11) connected to said control signal furnishing means for furnishing a timing signal at a predetermined point in each cycle of said cyclical control signal; and switch control means (21, 23) connected to said timing signal furnishing means, said limiting speed detector means and said ignition switch means for switching said ignition switch means to said first stable state at a time coincident with or following said timing signal in the absence of said upper speed range signal and at a time preceding said timing signal in the presence of said upper speed range signal; and wherein said switch control means comprising first switch control means (19) connected to said limiting speed detector means for switching said ignition switch means to said first stable state in response to a comparator output signal in the presence of said upper speed range signal;

reference signal furnishing means (15) for furnishing a reference signal;

and comparator means (13) connected to said reference signal furnishing means, said control signal furnishing means and said first switch control means for furnishing said comparator output signal to said switch control means when said cyclical control signal has a predetermined relationship to said reference signal.

2. A system as set forth in claim 1, wherein said speed varying cyclical control signal is an AC signal;

and wherein said timing signal furnishing means furnish said timing signal at alternate passages through zero of said AC signal.

3. A system as set forth in claim 1, wherein said reference signal furnishing means comprises means connected to said timing signal furnishing means for furnishing a speed-varying reference signal.

4. A system as set forth in claim 3, wherein said spark creating means comprises a coil (27) having a primary winding and a secondary winding, and a spark plug (28) connected in series with said secondary winding;

wherein said ignition switch means comprises controllable ignition switch means having a conductive state in the presence of a switch enabling signal and a blocked state in the absence of said switch enabling signal, said conductive and blocked states corresponding, respectively, to said first and second stable states;

and wherein said first switch control means comprises means for furnishing said switch enabling signal upon receipt of said comparator output signal and terminating said switch enabling signal upon receipt of said timing signal.

5. A system as set forth in claim 4, further comprising additional spark creating means (25, 29, 31, 32) for creating a plurality of additional sparks following said terminating of said switch enabling signal.

6. A system as set forth in claim 5, wherein said additional spark creating means comprises means for creating additional sparks within a predetermined time interval following said termination of said switch enabling signal.

7. A system as set forth in claim 5, wherein said switch enabling signal constitutes a first switch enabling signal; wherein a primary current flows through said primary winding and said ignition switch means when said ignition switch means is in said conductive state; and wherein said additional spark creating means comprises additional spark timing means for furnishing a second switch enabling signal a predetermined time instant following said terminating of said first switch enabling signal and for terminating said second switch enabling signal when said primary current has an amplitude corresponding to a predetermined threshold amplitude.

8. A system as set forth in claim 7, wherein said additional spark creating means comprises current measuring means (25) for furnishing a measurement signal corresponding to said amplitude of said primary current, threshold circuit means (29) connected to said current measurement means for furnishing a threshold output signal when said amplitude of said primary current exceeds said predetermined threshold amplitude, and means (31) for switching said additional spark timing means to terminate said second enabling signal upon receipt of said threshold output signal.

9. A system as set forth in claim 6, wherein said additional spark creating means further comprises band limiting signal furnishing means (12, 14, 22) connected to said control signal furnishing means for furnishing a band limiting signal present only throughout said predetermined time interval, and band limiting logic means (23) connected to said band limiting signal furnishing means and said additional spark timing means for transmitting signals from said additional spark timing means to said ignition switch means only in the presence of said band limiting signal.

10. A system as set forth in claim 9, wherein said band limiting signal furnishing means comprises differentiating circuit means (120) connected to said control signal furnishing means for differentiating said control signal and furnishing a differentiated control signal having a positive and a negative half-wave, and first inverter means (121) connected to said differentiating circuit means for furnishing a first pulse extending for the duration of said negative half-wave of said differentiating control signal;

wherein said control signal has a positive and a negative half-wave;

wherein said timing signal furnishing means comprises means for furnishing a second pulse extending for the duration of said negative half-wave of said control signal;

and wherein said band limiting signal furnishing means further comprises first logic means (14, 22) for furnishing said band limiting signal in the joint presence of said first and second pulse.

11. A system as set forth in claim 1, wherein said switch control means switches said ignition switch means to said first stable state in response to said timing signal in the absence of said upper speed range signal.

* * * * *